United States Patent [19]

Culling

[11] Patent Number: 4,861,547

[45] Date of Patent: Aug. 29, 1989

[54] IRON-CHROMIUM-NICKEL HEAT RESISTANT ALLOYS

[75] Inventor: John H. Culling, St. Louis, Mo.

[73] Assignee: Carondelet Foundry Company, St. Louis, Mo.

[21] Appl. No.: 179,846

[22] Filed: Apr. 11, 1988

[51] Int. Cl.[4] ..... C22C 38/44; C22C 30/00

[52] U.S. Cl. ..... 420/53; 420/47; 420/453; 420/586

[58] Field of Search ..... 420/53, 43, 47, 584, 420/453, 586.1

[56] References Cited

U.S. PATENT DOCUMENTS

| | | | |
|---|---|---|---|
| 2,416,515 | 2/1947 | Evans | 420/53 |
| 2,537,477 | 1/1951 | MOhling et al. | 420/53 |
| 2,703,277 | 3/1955 | Spendelow et al. | 420/454 |
| 3,127,265 | 3/1964 | Avery | 420/588 |
| 3,164,465 | 1/1965 | Thielemann | 420/586 |
| 3,607,250 | 9/1971 | English et al. | 420/585 |
| 3,758,299 | 9/1973 | Ennis et al. | 420/588 |
| 4,077,801 | 3/1978 | Heyer et al. | 420/584 |

FOREIGN PATENT DOCUMENTS

| | | | |
|---|---|---|---|
| 60-59051 | 4/1985 | Japan | 420/584 |
| 1046603 | 10/1966 | United Kingdom | 420/427 |

*Primary Examiner*—Deborah Yee

*Attorney, Agent, or Firm*—Senniger, Powers, Leavitt and Roedel

[57] ABSTRACT

Modified ACI-type alloys having creep rupture strengths higher than such alloys which retain the resistance to hot tearing or cracking during casting or welding as is associated with the standard ACI alloy counterparts of such modified alloys. The modified alloys consist of about 8% and about 62% by weight nickel, between about 12% and about 32% by weight chromium, between about 0.05% and about 1.5% by weight molybdenum, less than about 1% tungsten, between about 0.05% and about 1% by weight columbium (niobium), up to about 3% by weight silicon, up to about 3% by weight manganese, up to about 0.8% by weight carbon, up to about 0.5% by weight nitrogen, and the balance essentially iron.

12 Claims, No Drawings

IRON-CHROMIUM-NICKEL HEAT RESISTANT ALLOYS

This invention relates to iron-chromiun-nickel heat resistant alloys having improved resistance to "hot shortness" or "hot tearing" when used to make static castings.

BACKGROUND OF THE INVENTION

There is a very extensive use of heat-resistant cast alloys in various industries. These alloys have been standardized by the Alloy Castings Institute (ACI) Division of the Steel Founders Society of America and given various designations, such as HH or HP.

The ACI designations use a prefix of H for alloys intended for heat-resistance services. The second letter of the ACI designation indicates the specific grade or alloy type, with a rough alphabetical sequence as nickel content rises. The various grades that have now become standardized are listed in Table I along with their standard compositional limits.

TABLE I

Standard Cast Heat-Resistant Alloys For Industrial Applications Weight Percent of Elements

| Cast Alloy Designation | Cast Heat Resistant Alloys for Industrial Applications Composition-percent (balance essentially Fe) | | | | | | | |
|---|---|---|---|---|---|---|---|---|
| | Ni | Cr | C | Mn Max. | Si Max. | P Max. | S Max. | Other Elements |
| HF | 9–12 | 19–23 | 0.20–0.40 | 2.00 | 2.00 | 0.04 | 0.04 | Mo 0.5 max |
| HH | 11–14 | 24–28 | 0.20–0.50 | 2.00 | 2.00 | 0.04 | 0.04 | Mo 0.5 max. N 0.2 max |
| HI | 14–18 | 26–30 | 0.20–0.50 | 2.00 | 2.00 | 0.04 | 0.04 | Mo 0.5 max |
| HK | 18–22 | 24–28 | 0.20–0.60 | 2.00 | 2.00 | 0.04 | 0.04 | Mo 0.5 max |
| HL | 18–22 | 28–32 | 0.20–0.60 | 2.00 | 2.00 | 0.04 | 0.04 | Mo 0.5 max |
| HN | 23–27 | 19–23 | 0.20–0.50 | 2.00 | 2.00 | 0.04 | 0.04 | Mo 0.5 max |
| HP | 33–37 | 24–28 | 0.35–0.75 | 2.00 | 2.00 | 0.04 | 0.04 | Mo 0.5 max |
| HT | 33–37 | 15–19 | 0.35–0.75 | 2.00 | 2.50 | 0.04 | 0.04 | Mo 0.5 max |
| HU | 37–41 | 17–21 | 0.35–0.75 | 2.00 | 2.50 | 0.04 | 0.04 | Mo 0.5 max |
| HW | 58–62 | 10–14 | 0.35–0.75 | 2.00 | 2.50 | 0.04 | 0.04 | Mo 0.5 max |

Numerous non-standard cast heat-resistant alloys have been developed which have increased hot strength and service life at elevated temperatures beyond the levels normally provided by the standard ACI alloys. These alloys provide the option of improved performance over those provided by the ACI standard grades but at greatly increased costs and restricted availability. Such non-standard alloys have contained one or more additional elements as follows: 3 to 15% cobalt, 1.7 to 17% tungsten, 1.2 to 1.65% columbium, 3% molybdenum, and less than 1% zirconium. The iron content of these alloys ranges from about 36% to less than 1%.

Furthermore, in recent decades, the standard grades of wrought steels have been improved by relatively small additions of extra elements with often dramatic improvements in properties. These additions have often been of small enough proportions that they have been called microalloy additions.

High temperature strength, measured as creep rupture strength, is usually the predominant property of interest with respect to ACI standard base alloys. U.S. Pat. No. 4,077,801 of Heyer and Huth discloses microalloy additions to the standard ACI heat-resistant casting alloys of 0.05 to 2% tungsten and 0.05 to less than 1% titanium. These additions are said to produce values of creep rupture strengths in the HH through HP grades at least 5% higher than those of the standard grades.

However, many industrial castings have configurations or designs which tend to cause restriction or resistance to the normal shrinkage that takes place during the final freeze and cool down from their pouring temperatures. The resulting thermal stresses cause cracks in the final castings, called hot cracks or hot tears, while metallic alloys especially prone to this defect are said to be hot short or have hot shortness.

Because of their increased rupture strengths, the alloys described in U.S. Pat. No. 4,077,801 are particularly beneficial in the production of centrifugally cast pipes for heat service. Those alloys have also been successfully used in static casting techniques for castings which are of configurations not very susceptible to hot tearing during freezing from molten metal to the solid finished form. On the other hand, those alloys have not been used successfully for static castings having configurations which restrict normal shrinkage during cool down because they are susceptible to the hot shortness problem.

The retention of the high temperature strength afforded by the microalloyed ACI-type alloys nevertheless remains of special interest when the alloy is employed in such static castings, for example, large castings formed around large cored center cavities, such as heat treating retorts. Therefore, there has remained a need for modifying standard ACI heat-resistant alloys in order to increase their strengths while also avoiding an increase in their tendencies toward hot shortness.

SUMMARY OF THE INVENTION

Among the objects of the present invention is to provide simple, relatively low cost alloys having creep rupture strengths at least 5% greater than the standard ACI-type and similar heat-resistance alloys. A further object is to provide alloys of relatively low tungsten content and not requiring the addition of titanium having increased rupture strengths and greatly improved resistance to hot-tearing or hot-cracking when used in the production of static castings. Additional objects include the provision of alloys with improved weldability over those strenghtened by the use of tungsten/-titanium combinations and the provision of such alloys that may be readily produced by ordinary air-melting and air-casting techniques. A singularly important object of this invention is to provide such alloys that may be formulated by relatively small additions of molybdenum, tungsten and columbium (niobium), and to castings, especially static castings, made with such alloys.

Briefly, therefore, the present invention is directed to air-meltable, air-castable, weldable heat-resistant alloys that are resistant to hot-tearing or hot-cracking, and exhibit high creep rupture strengths. The instant alloys consist of between about 8% and about 62% by weight nickel, between about 12% and about 32% by weight chromium, between about 0.05% and about 1.5% by weight molybdenum, less than about 1% tungsten, between about 0.05% and about 1% by weight columbium (niobium), up to about 3% by weight silicon, up to about 3% by weight manganese, up to about 0.8% by weight carbon, up to about 0.5% by weight nitrogen, and the balance essentially iron.

DESCRIPTION OF THE PREFERRED EMBODIMENTS

In accordance with the present invention, alloys are provided which are virtually equal to their standard ACI counterparts in resistance to hot-tearing or hot-cracking during casting or welding and have at the same time at least 5% higher creep rupture strength than those counterparts.

The alloys of this invention are air-meltable and air-castable by the usual methods and may be formulated by the addition of relatively minor additions of molybdenum, tungsten and columbium to the standard ACI-type alloys. Preferably, the weight ratio of molybdenum to tungsten to columbium is from about 1:1:1 to about 4:2:1, i.e., they contain between about 1 and about 4 parts by weight Mo, and between abut 1 and about 2 parts by weight W, per part by weight Cb.

The essential components of the alloys of the invention are:

| | |
|---|---|
| Nickel | 8 to 62% by weight |
| Chromium | 12 to 32% |
| Molybdenum | 0.05 to 1.5% |
| Tungsten | 0.05 to 0.8% |
| Columbium | 0.05 to 1% |
| Carbon | 0.25 to 0.8% |
| Iron | Essentially balance |

The alloys of the invention may also contain:

Silicon up to 3%

Manganese up to 3%

Nitrogen up to 0.5%

Depending upon the property to be emphasized, adjustments of the concentration of ingredients can be made within the ranges set forth above. For example, for maximum resistance to hot-tearing coupled with maximum increase in creep rupture strength, it has been found preferable that alloys of this invention contain the following ranges of the specified ingredients:

| Alloy (A) | |
|---|---|
| Nickel | 8 to 62% |
| Chromium | 12 to 32% |
| Molybdenum | 0.25 to 1.1% |
| Tungsten | 0.20 to 0.55% |
| Columbium | 0.10 to 0.50% |
| Silicon | 0.2 to 2% |

In an especially preferred embodiment of the invention, the following ranges of ingredients have been found to maximize hot strength along with excellent resistance to hot-tearing:

| Alloy (B) | |
|---|---|
| Nickel | 8 to 62% |

-continued

| Alloy (B) | |
|---|---|
| Chromium | 12 to 32% |
| Molybdenum | 0.45 to 0.65% |
| Tungsten | 0.45 to 0.65% |
| Columbium | 0.45 to 0.65% |

In another especially preferred embodiment of the invention, the following ranges of ingredients have been found to maximize resistance to hot-tearing along with excellent hot strength.

| Alloy (C) | |
|---|---|
| Nickel | 8 to 62% |
| Chromium | 12 to 32% |
| Molybdenum | 0.8 to 1.1% |
| Tungsten | 0.4 to 0.5% |
| Columbium | 0.25 to 0.35% |

In the three alloys exemplified immediately above, namely alloys (A), (B), and (C), the balance of the compositions was essentially iron. However they can contain, as can all the alloys of this invention, the normal tramp elements, oxidizers and foundry impurities.

Thus the preferred alloys of this invention can contain, by weight, between about 8% and about 62% nickel, between about 12% and about 32% chromium, between about 0.25% and about 1.1% molybdenum, between about 0.05% and about 0.8% tungsten, preferably no more than about 0.65% tungsten, between about 0.10% and about 0.65% columbium, up to about 1% silicon, up to about 0.5% carbon, up to about 0.2% nitrogen, and the balance essentially iron.

The following examples further illustrate the invention:

EXAMPLE 1

Heats of several different alloys were prepared in accordance with this invention by adding small quantities of molybdenum, tungsten and columbium to otherwise basic ACI-type HK alloys. Well-risered standard ASTM test bar keel blocks were cast from each heat.

The composition of these alloys is set forth in Table II, with the balance in each instance being essentially iron.

TABLE II

| Specimen Number | % by weight of alloying elements | | | | | | | | |
|---|---|---|---|---|---|---|---|---|---|
| | Ni | Cr | Mo | W | Cb | C | N | Mn | Si |
| HK | 20.23 | 25.11 | — | — | — | 0.42 | 0.06 | 0.81 | 0.44 |
| 3001 | 20.07 | 24.97 | 0.52 | 0.51 | 0.50 | 0.49 | 0.06 | 0.82 | 0.53 |
| 3002 | 20.11 | 25.21 | 1.02 | 0.49 | 0.26 | 0.47 | 0.07 | 0.81 | 0.67 |
| 3003 | 21.15 | 26.22 | 0.82 | 0.41 | 0.30 | 0.48 | 0.04 | 0.77 | 0.72 |
| 3004 | 19.95 | 27.71 | 0.57 | 0.54 | 0.51 | 0.44 | 0.14 | 1.25 | 0.66 |
| 3005 | 19.82 | 25.55 | 0.83 | 0.47 | 0.33 | 0.43 | 0.12 | 0.96 | 0.36 |
| 3006 | 12.20 | 25.21 | 0.62 | 0.54 | 0.49 | 0.47 | 0.11 | 0.59 | 0.97 |
| 3007 | 21.82 | 26.17 | 0.61 | 0.58 | 0.52 | 0.53 | 0.05 | 0.46 | 0.36 |
| 3008 | 20.64 | 27.01 | 0.55 | 0.51 | 0.51 | 0.51 | 0.07 | 0.42 | 1.08 |

Standard ASTM creep-rupture test bars were machined from each block and tested under 5000 PSI load at 1800° F. until rupture in Applied Test Systems, Inc., creep rupture frames. Results of these tests are reported in Table III.

TABLE III

| Specimen Number | Rupture Time in Hours At 1800° F. At 5000 PSI Load On 0.25 Inch Diameter Test Bars |
|---|---|
| HK-1 | 82.2 |
| HK-2 | 102.4 |
| 3001 | 546.1 |
| 3002 | 364.4 |
| 3003 | 243.1 |
| 3004 | 582.3 |
| 3005 | 381.2 |
| 3006 | 552.2 |
| 3007 | 420.4 |
| 3008 | 455.6 |

By comparison, alloys of the HK base type but modified by the addition of tungsten and titanium in amounts of about 1.0% and 0.3%, respectively, when tested under the same conditions as were used in Example 1 have rupture times at 1800° F. and 5000 psi load of about 300 to 450 hours.

EXAMPLE 2

Heats of several different alloys were prepared and tested as in Example 1 except that the ACI-type HH base alloy was used. The composition of these alloys is set forth in Table IV, with the balance in each instance being essentially iron.

TABLE IV

| Specimen Number | % by weight of alloying elements | | | | | | | | |
|---|---|---|---|---|---|---|---|---|---|
| | Ni | Cr | Mo | W | Cb | C | N | Mn | Si |
| HH | 13.78 | 25.22 | — | — | — | 0.41 | 0.07 | 0.82 | 0.64 |
| 3009 | 13.66 | 27.21 | 0.54 | 0.51 | 0.46 | 0.44 | 0.14 | 0.76 | 0.88 |
| 3010 | 12.81 | 24.83 | 0.58 | 0.49 | 0.43 | 0.47 | 0.11 | 1.23 | 0.33 |
| 3011 | 13.02 | 25.64 | 0.86 | 0.43 | 0.28 | 0.49 | 0.12 | 1.09 | 0.46 |
| 3012 | 12.94 | 24.27 | 0.96 | 0.48 | 0.31 | 0.39 | 0.18 | 0.64 | 0.89 |
| 3013 | 12.77 | 25.03 | 0.66 | 0.52 | 0.34 | 0.37 | 0.16 | 0.52 | 1.04 |

Following the procedure of Example 1 the rupture life of each of these alloys under a load of 5000 PSI at 1800° F. was determined and is reported in Table V.

TABLE V

| Specimen Number | Rupture Time in Hours At 1800° F. At 5000 PSI Load On 0.25 Inch Diameter Test Bars |
|---|---|
| HH-1 | 22.1 |
| HH-2 | 31.7 |
| 3009 | 329.3 |
| 3010 | 414.6 |
| 3011 | 387.8 |
| 3012 | 383.7 |
| 3013 | 232.3 |

By comparison, alloys of the HH base type but modified by the addition of tungsten and titanium in amounts of about 1.0% and 0.3%, respectively, when tested under the same conditions as were used in Example 2 have rupture times at 1800° F. and 5000 psi load of about 200 to 300 hours.

EXAMPLE 3

As a further illustration of the merits of this invention three castings of a heat treating retort were prepared using HT base alloy modified by the addition of 0.5% tungsten and 0.3% titanium. The retort was 34 inches in diameter and 16½ feet long with a wall thickness of ¾ inches for most of its length blending into ⅞ inches wall thickness at one end. Each casting contained one to three cracks of about ½ inch to 1 inch width extending from about ½ to almost the full circumference of the casting.

A heat treating retort was then cast using an alloy of this invention which was HT base alloy modified by the addition of 0.50% molybdenum, 0.25% tungsten and 0.15% columbium. Specifically, the modified alloy contained, in addition to those three elements, 35.82% Ni, 16.33% Cr, 0.76% Mn, 0.82% Si, 0.53% C, and 0.19% N, with the balance essentially Fe. No cracks were observed in the casting. Following the procedure of Example 1 this alloy was found to have a rupture life of 383 hours when tested at 1800° F. for 5000 psi load whereas standard HT base alloy has a rupture life of about 35 to 105 hours under the same conditions.

From the foregoing it is evident that the alloys of this invention, which are provided by the addition of controlled proportions of molybdenum, columbium and tungsten to standard ACI base alloys, provide foundry operators with the opportunity to manufacture castings, either centrifugally or statically, having maximum resistance to hot tearing along with hot strength at least 5% greater than the ACI base alloys. These alloys are prepared by conventional methods of melting, and no special conditions, such as controlled atmosphere, special furnace linings, protective slags or special molding materials are required. Because of the relatively low strategic or critical metal content and correspondingly high iron content of these alloys, they may be formulated from relatively low-cost raw materials, such as scrap, ferro alloys or other commercial melting alloys.

Except in the relatively narrow composition ranges where the alloy structure is not sufficiently austentic, the alloys of the invention are readily weldable and machinable and, most importantly, are possessed of sufficient ductility to be shaped and processed by hot or cold-working. The alloys of the invention which are not readily workable generally possess the alternative advantageous properties of high hardness and wear resistance. In either case, these alloys are adapted for use as materials of construction for a wide variety of chemical and other industrial process equipment.

Further, the alloys of the invention are highly resistant to corrosion by sulfuric acid solutions over a wide range of compositions, and are suitable for use at elevated temperatures with such solutions containing various contaminants. They may be cast or wrought. They have low hardness and high ductility so that they generally may be readily rolled, forged, welded and machined.

The alloys of this invention allow section for maximizing hot strength or maximizing resistance to hot tearing while, in either case, offering the opportunity to maintain the non-maximized property at least at the level provided by the standard ACI base alloys. Also, the alloys of this invention avoid the need to use titanium which can cause non-metallic inclusions in the form of $TiO_2$ or other oxides of titanium. Furthermore, when using titanium in conventional air melting and air pouring there is often an inconsistent recovery of titanium in the alloy resulting in an undesired amount of out of specification material.

In view of the above, it will be seen that the several objects of the invention are achieved and other advantageous results attained.

As various changes could be made in the above products without departing from the scope of the invention, it is intended that all matter contained in the above description shall be interpreted as illustrative and not in a limiting sense.

What is claimed is:

1. An air-meltable and air-castable alloy which is free of titanium consisting essentially of, in weight percent, between about 8% and about 62% nickel, between about 12% and about 32% chromium, between about 0.25% and about 1.1% molybdenum, between about 0.05% and about 0.8% tungsten, between about 0.10% and about 0.65% columbium, up to about 0.5% carbon, up to about 1% silicon, up to about 3% manganese, up to about 0.2% nitrogen, and the balance essentially iron.

2. An alloy as set forth in claim 1 wherein the tungsten content is between about 0.20% and about 0.55% and the columbium content is between about 0.10% and about 0.50%.

3. An alloy as set forth in claim 1 wherein the molybdenum content is between about 0.45 and about 0.65%, the tungsten content is between about 0.45 and about 0.65%, and the columbium content is between about 0.45 and about 0.65%.

4. An alloy as set forth in claim 3 wherein the weight ratio of molybdenum to tungsten to columbium is about 1:1:1.

5. An alloy as set forth in claim 1 wherein the molybdenum content is between about 0.8 and about 1.1%, the tungsten content is between about 0.4 and about 0.5% and the colmbium content is between about 0.25 and about 0.35%

6. An alloy of claim 5 wherein the weight ratio of molybdenum to tungsten to columbium is about 4:2:1.

7. An alloy consisting essentially of, in weight percent, between about 19% and about 22% nickel, between about 25% and about 28% chromium, between about 0.5% and about 0.7% molybdenum, between about 0.5% and about 0.6% tungsten, between about 0.5% and about 0.6% columbium, between about 0.4% and about 0.5% carbon, between about 0.10% and about 0.15% nitrogen, between about 0.5% and about 1.5% manganese, between about 0.5% and about 1.0% silicon, and the balance essentially iron.

8. An alloy consisting essentially of, in weight percent, between about 12.8% and about 13.0% nickel, between about 24.2% and about 24.9% chromium, between about 0.5% and about 1.0% molybdenum, between about 0.4% and about 0.5% tungsten, between about 0.25% to 0.45% columbium, between about 0.4% and about 0.5% carbon, between about 0.10% and about 0.20% nitrogen, between about 0.60% and about 1.30% manganese, between about 0.30% and about 0.90% silicon, and the balance essentially iron.

9. An alloy as forth in claim 8 wherein the weight ratio of molybdenum to tungsten to columbium is about 1:1:1.

10. An alloy consisting essentially of, in weight percent, about 35.8% nickel, 16.3% chromium, 0.7% manganese, 0.8% silicon, 0.5% carbon, 0.2% nitrogen, 0.50% molybdenum, 0.25% tungsten, 0.15% columbium, and the balance essentially iron.

11. An alloy of claims 1 and 2 wherein the weight ratio of molybdenum to tungsten to columbium is in the range of about 1:1:1 to about 4:2:1.

12. An alloy as set forth in claim 1 wherein the tungsten content is between about 0.05% and about 0.65%.

* * * * *